US010597904B2

(12) United States Patent
Hintz et al.

(10) Patent No.: US 10,597,904 B2
(45) Date of Patent: Mar. 24, 2020

(54) APPLIANCE LOCK WITH VOLTAGE ENCODED WIRING

(71) Applicant: ILLINOIS TOOL WORKS INC., Glenview, IL (US)

(72) Inventors: Michael K. Hintz, Waukesha, WI (US); Michael S. Osvatic, Waukesha, WI (US); Jason L. Berry, Racine, WI (US); William D. Chatelle, Cranston, RI (US)

(73) Assignee: Illinois Tool Works Inc., Glenview, IL (US)

( * ) Notice: Subject to any disclaimer, the term of this patent is extended or adjusted under 35 U.S.C. 154(b) by 1060 days.

(21) Appl. No.: 14/761,586

(22) PCT Filed: Dec. 31, 2013

(86) PCT No.: PCT/US2013/078465
§ 371 (c)(1),
(2) Date: Jul. 16, 2015

(87) PCT Pub. No.: WO2014/113211
PCT Pub. Date: Jul. 24, 2014

(65) Prior Publication Data

US 2015/0361690 A1 Dec. 17, 2015

Related U.S. Application Data

(60) Provisional application No. 61/753,476, filed on Jan. 17, 2013.

(51) Int. Cl.
*E05B 47/00* (2006.01)
*D06F 37/42* (2006.01)
(Continued)

(52) U.S. Cl.
CPC ..... *E05B 47/00* (2013.01); *A47L 15/4259* (2013.01); *D06F 37/42* (2013.01);
(Continued)

(58) Field of Classification Search
CPC .. E05B 61/00; E05B 47/0001; E05B 47/0002; E05B 47/00; E05B 2047/0048;
(Continued)

(56) References Cited

U.S. PATENT DOCUMENTS 4,053,939 A * 10/1977 Nakauchi ..... E05B 47/0603 292/144
4,510,777 A * 4/1985 Ellingson ..... D06F 37/42 134/57 DL
(Continued)

FOREIGN PATENT DOCUMENTS

CN 1077626 C 1/2002
CN 101506426 A 8/2009
(Continued)

OTHER PUBLICATIONS

Translation of JP06036643A, pp. 1-13 (Year: 2018).*
ISR and WO for PCT/US2013/078465 dated Mar. 20, 2014.

*Primary Examiner* — Christine M Mills
(74) *Attorney, Agent, or Firm* — Boyle Fredrickson, S.C.

(57) ABSTRACT

A lock system for an appliance providing multiple detection switches for lid closure and lid locking encodes the switch states as different voltages on a single signal line to reduce wiring harness costs.

17 Claims, 3 Drawing Sheets

(51) Int. Cl.
*A47L 15/42* (2006.01)
*D06F 39/14* (2006.01)
*E05C 1/02* (2006.01)

(52) U.S. Cl.
CPC ..... *D06F 39/14* (2013.01); *E05C 1/02* (2013.01); *E05B 2047/0048* (2013.01); *Y10T 292/1014* (2015.04)

(58) Field of Classification Search
CPC ..... E05B 2047/0054; E05B 2047/0067; E05B 2047/0068; E05B 2047/0069; E05C 1/02; D06F 37/42; D06F 39/14; Y10T 29/49169; Y10T 292/1021; Y10T 292/1014; Y10T 292/1082; Y10T 292/03; Y10S 292/69; Y10S 292/66; F24C 15/022; F24C 15/02; F24C 15/028; F24C 3/124; F24C 3/12; F24C 3/122; F24C 3/126; A21B 1/00; A21B 3/02; A47L 15/4259; A47L 15/06; A47L 15/0081; A47L 15/4297; A47L 15/0002
USPC ..... 292/144, 201, 1, 138, DIG. 69, DIG. 66; 126/197, 192; 134/18, 57 DL, 58 DL
See application file for complete search history.

(56) References Cited

U.S. PATENT DOCUMENTS 4,568,998 A * 2/1986 Kristy ..... G07C 9/00182 340/5.64
4,623,179 A * 11/1986 Davis ..... D06F 37/42 292/201
4,744,021 A * 5/1988 Kristy ..... G07C 9/00182 340/5.5
4,995,650 A * 2/1991 Schantz ..... D06F 37/42 292/201
5,038,587 A * 8/1991 Harmelink ..... D06F 37/42 292/DIG. 69
5,520,424 A * 5/1996 Hapke ..... D06F 37/42 292/198
5,682,772 A * 11/1997 Hapke ..... D06F 37/42 134/57 DL
5,742,964 A 4/1998 Choi
5,823,017 A * 10/1998 Hapke ..... D06F 37/42 68/12.26
5,879,036 A * 3/1999 Moline ..... D06F 37/42 292/210
6,750,568 B2 * 6/2004 Ohara ..... E05B 47/0012 307/141.4
7,251,961 B2 * 8/2007 Hapke ..... D06F 37/42 68/12.26
2010/0090746 A1 * 4/2010 Nakada ..... H03M 11/24 327/365
2015/0159407 A1 * 6/2015 Didier ..... E05B 81/68 292/197

FOREIGN PATENT DOCUMENTS

CN 201424589 Y 3/2010
DE 202010000610 U1 6/2010
JP 06036643 A * 2/1994
JP 2010098399 A * 4/2010 ..... H03M 11/24
JP 2015177223 A * 10/2015
KR 20000051165 A 8/2000
KR 1020050112351 A 11/2005
KR 1020060016450 A 2/2006
WO WO-2011031845 A1 * 3/2011 ..... D06F 39/14
WO WO-2011109235 A1 * 9/2011 ..... D06F 37/42
WO 2011138129 A1 11/2011

* cited by examiner

APPLIANCE LOCK WITH VOLTAGE ENCODED WIRING

CROSS REFERENCE TO RELATED APPLICATIONS

This application is National Phase of PCT/US2013/078465 filed Dec. 31, 2013 and claims the benefit of U.S. provisional application 61/753,476 filed Jan. 17, 2013 and hereby incorporated by reference.

FIELD OF THE INVENTION

The present invention relates to clothes washing machines and the like and specifically to a lock assembly providing a reduced wiring.

BACKGROUND OF THE INVENTION

During the spin cycle of a washing machine, water is removed from wet clothes centrifugally by spinning the clothes at high speed in a spin basket. In order to reduce the possibility of injury to the user, the user must be prevented from having access to the spin basket while the spin basket is in motion either during the spin or agitate cycle.

One way of protecting the user from access to the rotating spin basket uses an electrically locking latch for the washing machine lid. The latch holds and locks the lid in a closed position for the duration of the spin cycle and for a period after the spin cycle necessary for the spin basket to coast to a stop. This locking latch may be operated by a thermoelectric element such as a bimetallic strip or wax motor. Preferably, however, a fast acting solenoid or an electrical motor may be used for the locking mechanism to permit rapid access to the clothes when the spin basket has stopped. The electrical motor or a bi-stable solenoid may receive a first polarity pulse of electricity to lock the lid and a second polarity pulse of electricity to unlock the lid, thereby saving electrical power in the steady-state.

In order to prevent defeat of the lock, it is known to put a lid switch in series with the electrical actuator to prevent the locking action when the lid is open. This lid switch may be accompanied with a "lock switch" indicating that the bolt of the lock is engaged with a door strike. The lock switch is then placed in series with the washing machine motor or tied to the washing machine controller to prevent activation of the spin cycle when the lid is not properly locked. Together the lid closure switch and the lid lock switch provide some assurance that the lid is properly closed and locked before power is applied to the washing machine mechanism.

More recently, improved prevention of lock tampering has been provided by providing separate switches that detect both a locked state and an unlocked state of the lock. The separate switches provide the ability to detect a jamming of the lock mechanism preventing full movement of the lock mechanism between locked and unlocked states, such as may also indicate tampering or damage to the lock.

These additional switches require separate independent electrical conductors leading between the lock mechanism and the appliance control increasing the cost of the wiring harness and the complexity of manufacturing.

SUMMARY OF THE INVENTION

The present invention significantly decreases the cost of wiring needed to connect a multi-switch appliance lock to an appliance controller by encoding the multiple states of these physically separate switches into distinct electrical levels that may be conveyed over a single wire. This signal may be decoded at the appliance controller by an analog-to-digital converter.

Specifically, in one embodiment, the invention provides a door lock for a door of an appliance and a door locking element movable between an unlock position and lock position to lock the door. A door position switch is positioned to sense a closure of the door and a lock sensing switch is positioned to sense the door locking element being in the lock position. A first and second resistor each having different unique values are each attached to a corresponding one of the door position switch and the lock sensing switch so that corresponding switches control current through the corresponding attached resistors, the first, and second resistor communicating with a signal wire to provide a unique current through a signal wire as a function of the states of the door position switch and the lock sensing switch.

It is thus a feature of at least one embodiment of the invention to accurately convey the state of door closure and door locking switches through a single wire as different currents or voltages.

The door lock may further include an unlock sensing switch having a state indicating that the door locking element is in the unlock position and a third resistor having a different unique value from the first and second resistors, the third resistor attached to the unlock sensing switch which controls current through the third resistor. The first, second, and third resistors may communicate with the signal wire to provide a unique current through the signal wire as a function of the states of the door position switch, the lock sensing switch and the unlock sensing switch.

It is thus a feature of at least one embodiment of the invention to permit redundant switch signals without unduly increasing wiring harness cost.

The door lock may further include an electrical actuator that retains its state without power communicating with the door locking element to receive electrical power over an actuation wire to move the door locking element between the unlock and lock position. In one embodiment, the actuation element may be a bi-stable electrical solenoid or electrical motor.

It is thus a feature of at least one embodiment of the invention to provide necessary lock and unlock confirmation signals permitting energy-efficient actuators to be used in the door lock.

The first, second, and third resistors may be each connected in series, respectively, with one of the door position switch, the lock sensing switch and the unlock sensing switch, and wherein the series-connected resistors and switches are connected jointly in parallel to the signal wire. Alternatively, each of the first second and third resistors may be connected in parallel, respectively, with one of the door position switch, the lock sensing switch, and the unlock sensing switch, and the parallel connected resistors and switches may be connected jointly in series to the signal wire.

It is thus a feature of at least one embodiment of the invention to provide for flexible interconnection of the independent switches for encoding a combination signal on the signal wire.

The door lock may further include a sensing resistor receiving current from the signal wire to generate a voltage proportional to that current.

It is thus a feature of at least one embodiment of the invention to provide an output voltage that may be decoded into switch states.

The sensing resistor may be in the housing.

It is thus a feature of at least one embodiment of the invention to minimize the effect of harness resistance by converting current flow into a voltage within the housing and communicating the voltage over the harness to a high resistance input.

The first, second, and third resistors may each be greater than or equal to twice the resistance value of the next lowest resistance of the first, second and third resistors.

It is thus a feature of at least one embodiment of the invention to approximate a binary encoding system providing good noise immunity between encoded states.

Each of the resistor values may be less than 1000 ohms.

It is thus a feature of at least one embodiment of the invention to provide a low impedance resistor divider to be better immune from electrical interference.

Each of the door position switch, lock sensing switch and unlock sensing switch maybe independently mechanically operable.

It is thus a feature of at least one embodiment of the invention to encode switches that may assume a large number of combinational states.

Each of the door sensing switch, the lock sensing switch and the unlock sensing switch may be a single pole, single throw switches that close when the door is closed, the lock is in the lock position and the lock is in the unlock position, respectively.

It is thus a feature of at least one embodiment of the invention to employ switches whose failure in an open state would promote safe operation of the appliance.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

BRIEF DESCRIPTION DRAWINGS

Figure 1:
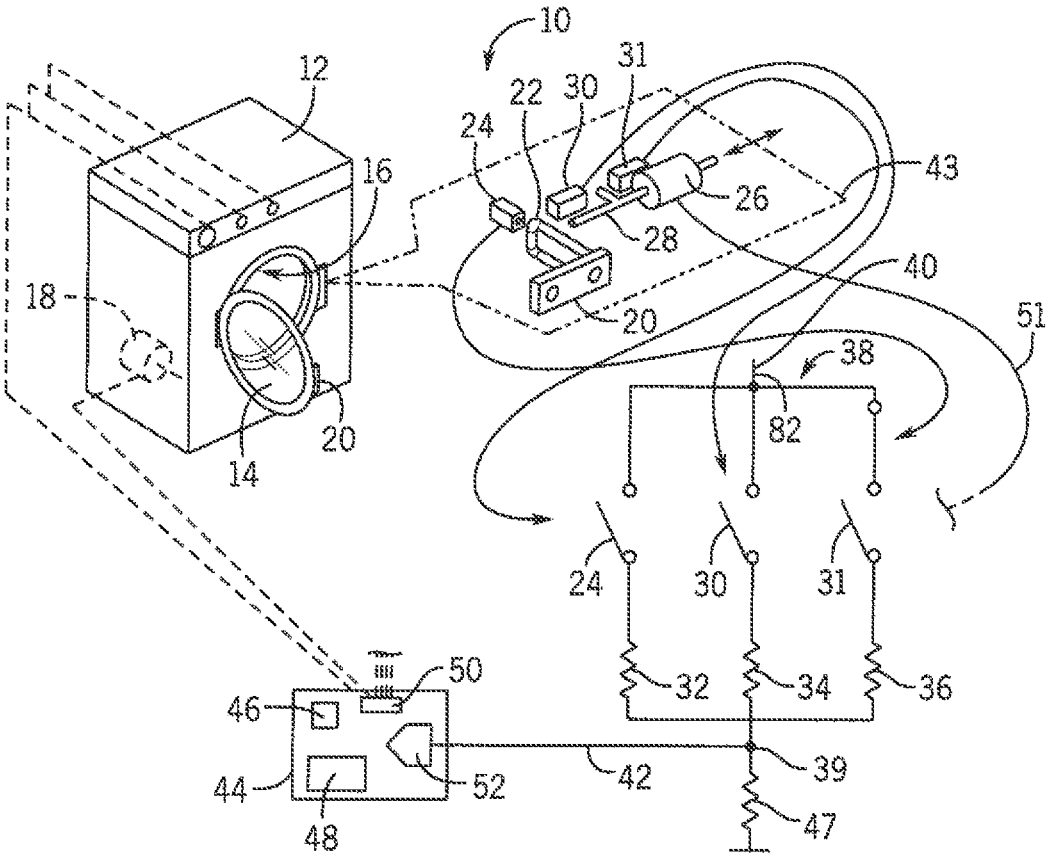
FIG. 1 is a simplified diagram of a locking latch of the present invention for a washing machine or the like showing an arrangement of a lid position sensor, lock and unlock switches and an electrical actuator moving a bolt to engage with a striker on the lid whose positions they be sensed over a single conductor (referenced to a voltage level)

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

Referring now to FIG. 1, a prior art locking latch 10 may work with an appliance 12. A front loading washing machine is shown having a door 14 that may open and close to selectively expose an internal spin basket 16 operated by a motor 18. The invention also contemplates use in a top loading washing machine.

The door 14 may hinge at one edge and at an opposed edge hold a striker 20 having a loop portion 22 that may pass into the housing of the appliance 12 to be received by the locking latch 10 held therein. The loop portion 22 of the striker 20, when the door 14 is closed, may activate a door position detector, being in this case an electrical door switch 24 (for example, a single pole single throw switch or a reed relay) indicating that the door is closed. The door switch 24 in this case may be a normally open switch that is open when the door 14 is open and closed when the door 14 is closed. Other indirect mechanisms for detecting door closure may also be used.

When the door 14 is closed, an electrical signal may be provided to an actuator 26, such as a bi-stable solenoid or permanent magnet DC motor, to drive a bolt 28 through the loop portion 22 to lock the door 14 against opening. A mechanical element attached to the bolt 28 may also activate a lock switch 30 when the door is so locked. The lock switch 30 is configured to be electrically open when the door 14 is unlocked and electrically closed when the door 14 is locked.

The mechanical element attached to the bolt 28 may also activate a home switch 31 when the door is unlocked. The home switch 31 is configured to be electrically open when the door is locked and electrically closed when the door 14 is unlocked. Generally, but not always, the state of the lock switch 30 and the home switch 31 will be opposite.

Each of the switches 24, 30, and 31, may be single pole, single throw switches connected in series to one of a set of corresponding resistors 32, 34 and 36 unique to each of the switches 24, 30, and 31. The series connected switches (24, 30, and 31) and resistors (32, 34, and 36) may be joined together in parallel to a node 39. A sensing resistor 47 may have one end connected to the node 39 and the other end connected to a reference voltage to provide a voltage divider encoding network 38. A driving voltage 40 may be applied to one side of the encoding network 38 through a power conductor 82 and the node 39 may be connected to a single signal line 42 to input to analog to digital converter 52 of a microcontroller 44 within the appliance 12.

Each of the switches 24, 30, 31 and resistors 32, 34, 36, and 47 together with the actuator 26 may be held in a housing 43 to provide an integrated locking mechanism.

Generally the microcontroller 44 will include a computer processor 46 communicating with a memory 48 holding a program in non-transient form for controlling general appliance functions including motor 18 and appliance displays based on signals received from appliance control knobs well known in the art. In this regard, the microcontroller 44 may include general input and output circuits 50 communicating with other elements of the appliance 12 and in particular an input to an analog-to-digital converter 52 receiving signal line 42. Generally, the program executed by the microcontroller 44 will suspend operation of the appliance 12 when the door 14 is open, and will provide for a locking of the door 14 during certain cycles of appliance operation and suspend operation of the appliance 12 if locking is not detected. Detection of tampering as will be discussed below may also cause the suspension of operation of the appliance 12. Such tampering may be indicated, for example, if no locking signal of switch 30 is detected after the actuator 26 has been energized.

Figure 2:
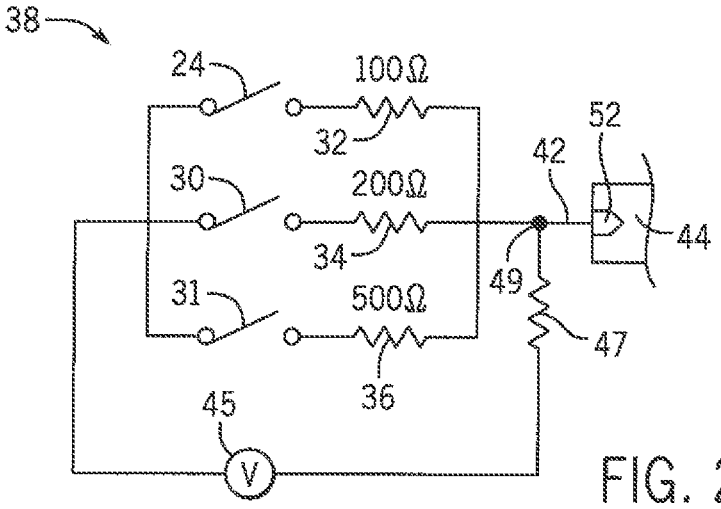
FIG. 2 is a schematic representation of a first embodiment of an encoding circuit for encoding switch states into voltage levels.

Referring now also to FIG. 2, in one embodiment, the resistors 32, 34, and 36 stand in an approximately binary sequence. Thus, for example, resistor 32 may be 100 ohms, resistor 34 200 ohms and resistor 36 500 ohms. It will be appreciated in this example that the exact binary values are not required and that these resistances may be adjusted so long as they remain approximately in this proportion and/or conform to standard resistance values.

As noted above, in one possible mode of operation, the encoding network 38 may be placed in series with a voltage source 45 (either AC or preferably DC) and a sensing resistor 47, the latter forming a voltage divider together with the effective total resistance of the encoding network 38. As different of the switches 24, 30, and 31 are opened and closed, the voltage at a node point 49 between the sensing resistor 47 and the encoding network 38, communicating with analog-to-digital converter 52, will vary uniquely depending on the combination of switch closures.

The following table shows the encoding of this embodiment:

TABLE I

| lid switch 24 | lock switch 30 | home switch 31 | Effective resistance of encoding network resistors 32, 34, 36 |
|---|---|---|---|
| Open | Open | Closed | 500 ohms |
| Closed | Open | Closed | 83 ohms |
| Closed | Closed | Open | 166 ohms |

It will be appreciated that the above table shows only legitimate states of the switches 24, 30, and 31 (each state representing one row) but that unique resistance values may also be provided for additional illegal states (for example, where the lock switch 30 and home switch 31 have the same state or where the lock switch 30 is locked while the lid is open). By detecting these illegal states, the present system can detect a variety of malfunctions. Each state provides a distinct and separate resistance but it will be appreciated that the difference in resistance between successive states need not be uniform and, in cases where some illegal states will not be sensed, a unique resistance is not necessary for each possible illegal state.

It will be understood that the variation of the effective resistance of the encoding network 38 will produce a corresponding change in the voltage at the node point 49 based on standard voltage divider equations and be dependent on the value of sensing resistor 47.

In this regard, the present invention allows the elimination of two wires associated with two of the switches 24, 30, and 31 and possibly four wires if one considers the separate return wires. Generally three wires will be required including the signal line 42, a ground connection 53 and an actuator wire 51 communicating with actuator 26. The ground connection 53 may be shared between the sensing switches 24, 30, and 31 and the actuator 26.

Figure 3:
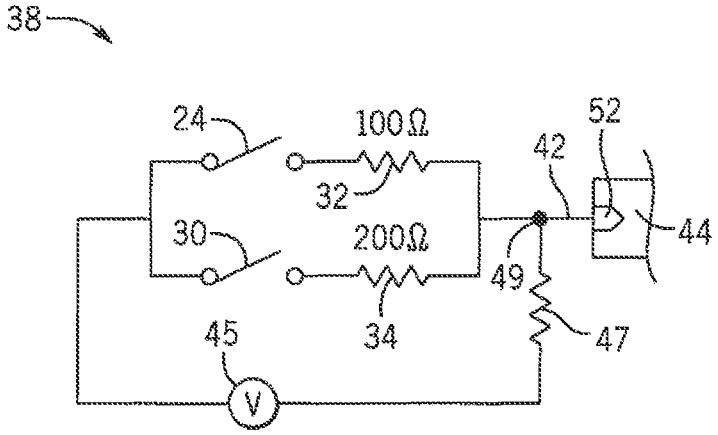
FIG. 3 is a figure similar to that of FIG. 2 of an alternative embodiment showing both switches and a current sensing of the encoded switch states.

Referring now to FIG. 3, it will be appreciated that the invention may also be used with two switches 24 and 30 only, for example, in cases where the extra switch 31 is not desired. Further, it will be appreciated that the voltage divider formed by sensing resistor 47 in FIG. 2 may alternatively be replaced with a current sensor measuring the current through the encoding network 38 in the manner of a current loop detector. In this latter embodiment, sensing resistor 47 can be removed.

Figure 4:
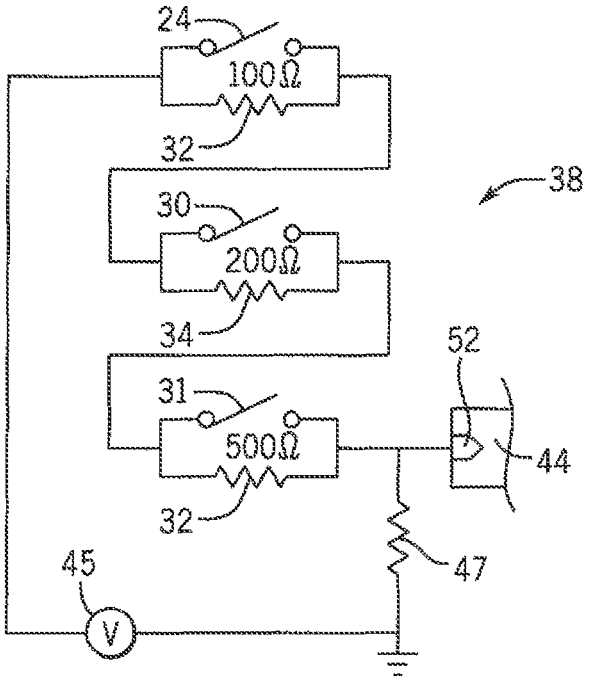
FIG. 4 is a figure similar to that of FIG. 2 showing an alternative wiring system.

Referring now to FIG. 4, it will be appreciated that the parallel wiring shown in FIG. 2 may be substituted with the serial wiring system. In this case switch 24 is wired in parallel with resistor 32, switch 30 is wired in parallel with resistor 34, and switch 31 is wired in parallel with resistor 32. The parallel connections of each switching resistor are then connected in series with sensing resistor 47 across voltage source 45. In this case the following encoding is provided:

TABLE II

| lid switch 24 | lock switch 30 | home switch 31 | Effective resistance of encoding resistors 32, 34, 36 |
|---|---|---|---|
| Open | Open | Closed | 300 ohms |
| Closed | Open | Closed | 200 ohms |
| Closed | Closed | Open | 500 ohms |

Figure 5:
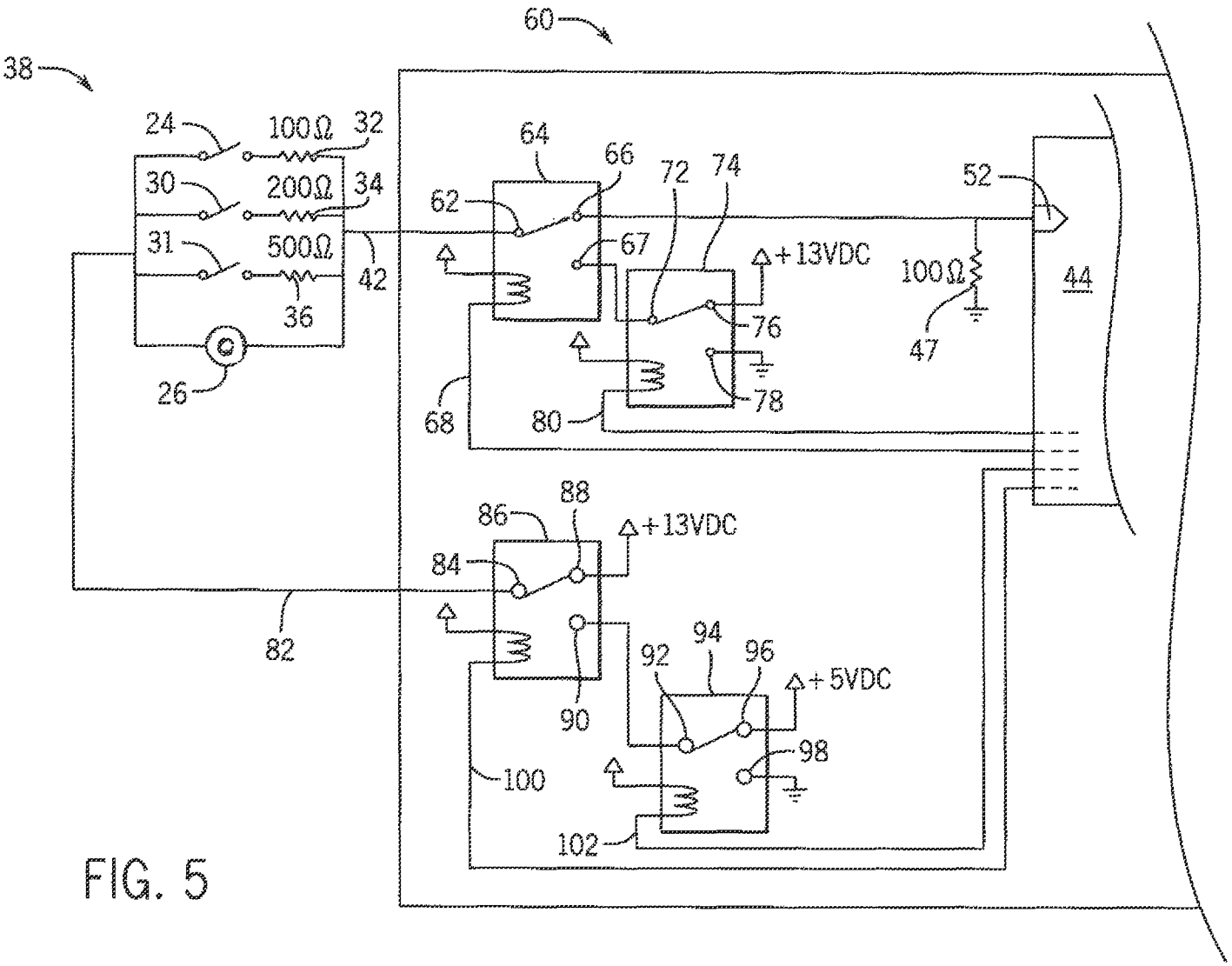
FIG. 5 is a schematic representation of an embodiment of the invention in which an electrical actuator such as a motor may be controlled over the same wire as that used to sense switch positions.

Referring now to FIG. 5, the same conductor of the signal line 42 used to sense the position or state of switches 24, 30, and 31 in the encoding network 38, may also be used to control the actuator 26 used to lock and unlock the appliance door. For this purpose, the actuator 26 is connected in parallel across the series combination of switch 24 and resistor 32, switch 30 and resistor 34; and switch 31 and resistor 36. In this example, the actuator 26 will have a resistance of approximately 40 ohms.

A more complex control circuit 60 may be employed with the encoding network 38 and parallel connected actuator 26. Signal line 42, in this case, will not lead directly to the analog to digital converter 52 of microcontroller 44 but will be received at a pole 62 of a first electrical relay 64, the first pole 62 switchable between a first and second throw 66 and 67 according to a control line 68 actuating a coil as shown or other control elements of a solid-state relay. Control line 68 may be received by a digital output 70 of the microcontroller 44 possibly with buffering circuitry (not shown).

Throw 66 connects to the A/D converter 52 and sensing resistor 47 as described above. Throw 66 connects to pole 72 of a second relay 74 having first and second throws 76 and 78 that connect, respectively, to a positive actuator drive voltage (for example 13 volts) and to ground. The switching of relay 74 is according to control signal 80 also received by a digital output 70 of the microcontroller 44.

The power conductor 82 of the encoder network 38, as is attached to the common junction of one terminal of switches 24, 30, 31, and actuator 26 (opposite the connection of signal line 42) may be received by a pole 84 of a third relay 86. This relay 86 provides a first throw 88 connected to the motor drive voltage and a second throw 90 connected to the first pole 92 of a fourth relay 94. A first throw 96 of relay 94 connects to a measurement voltage (e.g. five volts) and a second poll 98 of relay 94 connects to ground. Relay 86 may be controlled by signal line 100 and relay 94 may be controlled by signal line 102 both of which also connect a digital output 70.

It will be understood from this description that by proper control of relay 64, 86 and 94 by the microcontroller 44, that the measurement voltage may be applied to power conductor 82 and the resulting current conducted to the sensing resistor 47 and A/D converter 52 of microcontroller 44. The measurement voltage is selected to be insufficient to drive the actuator 26 thereby providing interrogation without actuation. In this case the state of the switches may be determined according the following Table III.

TABLE III

| lid switch 24 | lock switch 30 | home switch 31 | Effective resistance of encoding network resistors 32, 34, 36 and motor | voltage at A/D converter with 100 ohm sensing resistor 47 |
|---|---|---|---|---|
| Open | Open | Closed | 37 ohms | 3.65 v |
| Closed | Open | Closed | 26 ohms | 3.97 |
| Closed | Closed | Open | 24 ohms | 4.03 |

Alternatively, the state of relay 64 may be changed so that signal line 42 connects with pole 72 of relay 74. In this mode, it will be appreciated that control of relays 74, 86 and 94 may be performed to apply actuation voltage in either of two polarities across the electrical actuator 26. Sufficient current can be provided in this states to drive the actuator 26 regardless of the states of switches 24, 30 and 31 such as may shunt the actuator 26 with the resistances 32, 34 and 36.

In this way a single conductor of the signal line 42 (augmented by a separate power conductor 82) can provide not only a reading of the state of the locking latch 10 but may also power the latch to lock or unlock it depending on that state reading.

It will be understood that the present invention is applicable to a variety of different appliance types and that the motor 18 may be represented in such appliances by other electrical or mechanical elements that must be de-energized upon opening of the door for the safety of the user. It will be further understood that the present invention is equally applicable to top-load and front-load type washing machines and that the terms 'lid' and 'door' should be considered interchangeable in this regard.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A door lock for a door of an appliance, comprising:

a housing holding:

(a) a door position switch having a state indicating that the door is in a closed position;

(b) a door locking element movable between an unlock position and a lock position, the lock position engaging the door when the door is in the closed position to prevent the door from opening;

(c) a lock sensing switch having a state indicating that the door locking element is in the lock position;

(d) a door lock actuator for moving the door locking element upon receipt of an electrical lock signal;

(e) a first and second resistor having different unique values, each attached to a corresponding one of the door position switch and the lock sensing switch so that corresponding switches control current through the corresponding attached resistors; and a harness connection to a harness having no more than three wires and adapted to communicate between the housing and an appliance controller, the harness including:

a signal wire attached to a junction of the first and second resistors at a signal wire node to provide a unique electrical signal to the appliance controller through the harness as a function of different states of the door position switch and the lock sensing switch; and a ground wire connected to the signal wire node to provide a common ground for the door position switch, the lock sensing switch, and the door locking element.

2. The door lock of claim 1 further including an unlock sensing switch having a state indicating that the door locking element is in the unlock position and a third resistor having a different unique value from the first and second resistors, the third resistor attached to the unlock sensing switch which controls current through the third resistor;

wherein the first, second, and third resistors communicate with the signal wire to provide a unique current through the signal wire as a function of the states of the door position switch, the lock sensing switch and the unlock sensing switch.

3. The door lock of claim 2 wherein each of the first, second, and third resistors are connected in series respectively with a respective one of the door position switch, the lock sensing switch and the unlock sensing switch, and wherein the series connected resistors and switches are connected jointly in parallel to the signal wire.

4. The door lock of claim 2 wherein the first, second, and third resistors each have a resistance value that is greater than or equal to twice a resistance value of a next lowest resistance of the first, second, and third resistors.

5. The door lock of claim 2 wherein each of the door position switch, the lock sensing switch and the unlock sensing switch are independently mechanically operable.

6. The door lock of claim 5 wherein each of the door sensing switch, the lock sensing switch and the unlock sensing switch are open single pole, single throw switches that close when the door is closed, the lock is in the lock position and the lock is in the unlock position, respectively.

7. The door lock of claim 1 further including an electrical actuator having a state that is retained without power, communicating with the door locking element to receive electrical power to move the door locking element between the unlock position and the lock position and vice versa.

8. The door lock of claim 7 wherein the electrical actuator has a first terminal attached to the signal wire and a second terminal attached to a power wire communicating electrical current to each of the door position switch and lock sensing switch to be conducted to the signal wire.

9. The door lock of claim 7 wherein the electrical actuator is an electrical solenoid.

10. The door lock of claim 7 wherein the electrical actuator is an electrical motor.

11. The door lock of claim 7 further including a control network attached to the signal line and the power line to controllably connect a first measurement voltage across the signal and power line to measure a current conducted therebetween in a measurement state, and to controllably and at separate times attach each of two polarities of actuation voltage across the signal and power line to actuate the electrical actuator, wherein the measurement voltage does not actuate the electrical actuator.

12. The door lock of claim 1 further including a sensing resistor receiving current from the signal wire to generate a voltage proportional to that current.

13. The door lock of claim 12 wherein the sensing resistor is in a housing holding the first and second resistors.

14. The door lock of claim 1 further including a controller providing an analog-to-digital converter for measuring an electrical voltage and for processing by a stored program held in the controller and wherein the signal wire connects to the analog-to-digital converter.

15. The door lock of claim 14 further including a motor for operating the appliance and wherein the controller executes a stored program for allowing the motor to operate only when the electrical voltage at the analog-to-digital converter indicates a state of the door position switch that indicates that the door is closed and a state of the lock sensing switch indicating that the door is locked and the state of the unlock sensing switch indicating that the door is not unlocked.

16. The door lock of claim 1 wherein the first and second resistors all have values less than 1000 ohms.

17. A method of communicating a state of an appliance door that has been closed and locked in an appliance having a door lock including:

a housing holding:

(i) a door position switch positioned to respond to movement of the door to a closed position;

(ii) a door locking element movable between an unlock position and a lock position, the lock position engaging the door when the door is in the closed position to prevent the door from opening;

(iii) a lock sensing switch sensing a position of the door locking element in the lock position;

(iv) a door lock actuator for moving the door locking element upon receipt of an electrical lock signal;

(v) an unlock sensing switch sensing a position of the door locking element in the unlock position; and (vi) a first, second, and third resistor having different unique values, each attached to a corresponding one of the door position switch, the lock sensing switch, and the unlock sensing switch so that corresponding switch control current goes through the attached resistor;

a harness connection to a harness having no more than three wires and adapted to communicate between the housing and an appliance controller, the harness including:

a signal wire attached to a junction of the first, the second, and the third resistors to provide a unique electrical signal to the appliance controller through the harness as a function of different states of the door position switch and the lock sensing switch and the unlock sensing switch; and a ground wire providing a common ground for the door position switch, the lock sensing switch, and the door locking element;

the method comprising the steps of:

(a) sensing a voltage on the signal wire to match a voltage corresponding to closure and locking of the door without unlocking of the door; and (b) allowing operation of the appliance in at least one mode depending on a matching at step (a).

* * * * *